United States Patent [19]

Ladanyi

[11] Patent Number: 5,042,595

[45] Date of Patent: Aug. 27, 1991

[54] METHOD AND DEVICE FOR IN-SITU DETERMINATION OF RHEOLOGICAL PROPERTIES OF EARTH MATERIALS

[75] Inventor: Branko Ladanyi, Montreal, Canada

[73] Assignee: La Corporation De L'Ecole Polytechnique, Montreal, Canada

[21] Appl. No.: 474,381

[22] Filed: Feb. 5, 1990

[51] Int. Cl.[5] ..... E21B 47/00

[52] U.S. Cl. ..... 175/50; 73/84

[58] Field of Search ..... 175/18, 50; 73/84

[56] References Cited

U.S. PATENT DOCUMENTS

| | | | |
|---|---|---|---|
| 3,557,886 | 1/1971 | Cobbs | 175/50 |
| 3,611,794 | 10/1971 | Geeter | 175/50 X |
| 3,906,781 | 9/1975 | Vlasblom | 73/84 |
| 4,492,111 | 1/1985 | Kirkland | 73/84 |
| 4,543,820 | 10/1985 | Handy et al. | 73/84 |
| 4,554,819 | 11/1985 | Ali | 73/84 X |

OTHER PUBLICATIONS

"Sharp Cone Testing of Creep Properties of Frozen Sand" by B. Ladanyi and J. Sgaoula; pp. 12–18; (1989).

"Rheology–Its Structure And Its Position Among The Natural Sciences" by Hanswalter Giesekus; pp. 341–346 (1969).

"Rheology And Soil Mechanics" by M. J. Keedwell; pp. 67–79 (1984).

"Penetration Testing" by A. Verruijt et al.; pp. 671–678 (1982).

Ladanyi, B., Proc. 2nd Europ. Symp. on Penetration Testing, Amsterdam, (1982); vol. 1, pp. 671–678.

Ladanyi, B. and Johnston, G. H., Proc. 2nd Int. Permafrost Conf., Yakutsk, USSR North Amer. Contribution, NAS; Washington, D.C.; (1973); pp. 310–318.

Marchetti, S., J. of Geotech. Engrg. Div.; ASCE, vol. 106, No. GT3, (1980); pp. 299–321.

*Primary Examiner*—William P. Neuder

*Attorney, Agent, or Firm*—Foley & Lardner

[57] ABSTRACT

A method and device for determining in-situ rheological properties of earth materials are disclosed. A low-angle cone penetrometer is pushed into a predrilled cylindrical pilot hole of smaller diameter, to cause enlargement of the pilot hole. In one embodiment, the load applied to the cone is held constant and the relationship between the cone penetration and the time is recorded. In another embodiment, either the load on the cone or the rate of penetration into the pilot hole is held constant and the relationship between the penetration or the penetration rate and the resistance of the material against the enlargement of the pilot hole is recorded. The rheological properties of the material, such as the creep and time or rate-dependent deformation and strength properties, are then deduced from the recorded data.

28 Claims, 4 Drawing Sheets

METHOD AND DEVICE FOR IN-SITU DETERMINATION OF RHEOLOGICAL PROPERTIES OF EARTH MATERIALS

BACKGROUND OF THE INVENTION

The present invention relates to improvements in the field of earth materials testing. More particularly, the invention is concerned with an improved method and device for determining in-situ rheological properties of earth materials.

The knowledge of rheological properties of earth materials is an essential condition for the design of structural elements in contact with soils or rocks, to which they transfer the applied loads. Typical rheological properties are the creep properties of the material and its time or rate-dependent deformation or strength. The earth materials to which the invention pertains are soils, both frozen and unfrozen, ice, and weak rocks, such as rocksalt and potash. Practical problems requiring the knowledge of rheological properties of such earth materials are, for instance, the design of foundations in frozen and unfrozen soils, the bearing capacity of ice covers, and the design of tunnel and shaft linings.

For determining the above mentioned rheological properties, both laboratory and in-situ methods are presently being used. In the former, undisturbed soil samples are taken from borings at selected levels, and are subjected to certain tests pertinent to the purpose at hand. The latter, in-situ methods do not require soil sampling, but they permit to measure only a limited number of rheological properties. Their main advantages over the former are their rapidity and ability to furnish a continuous picture of the geotechnical profile of the site.

Not considering the geophysical methods, which measure only the physical properties of the ground, principal geotechnical in-situ methods presently in use are the Cone Penetration Test (CPT), the Pressuremeter Test (PMT) and the Flat Dilatometer Test (DMT).

The CPT method is a standardized method in which a pressure-sensitive cone having a diameter of 3.56 cm and an apex angle of 60°, and fixed to the end of a drill rod of the same diameter, is pushed into the soil at a rate of 2 cm/sec. From the recorded cone resistance (both total and piezometric pressure), certain mechanical properties of penetrated soils can be deduced, using theoretical models and statistical correlations. Although electrical cone tests have been in geotechnical use since 1950's, such tests have been introduced also to frozen soils only in the 1970's (see Ladanyi, B., "Determination of Geotechnical Parameters of Frozen Soils by Means of the Cone Penetration Test", Proc. 2nd Europ. Symp. on Penetration Testing, Amsterdam (1982), Vol. 1, pages 671–678). The CPT method, although being based on a continuous penetration mode, requires heavy penetration equipment and furnishes only information on soil strength properties, with no data on soil deformability and on stress-strain properties.

The PMT method, introduced to geotechnical practice by Menard in the 1950's, consists in placing an inflatable probe into a predrilled (or self-drilled) borehole of the same diameter. The hole is drilled down to a certain level, and the test is made at that level by keeping the probe fixed in place. The test is performed by inflating the probe and by recording the relationship between the applied pressure, the hole enlargement and the time. For any additional testing, the hole is drilled further, and the test is performed at another fixed level. In unfrozen soils, this method has been used essentially for determining the short-term mechanical properties of soils. The theoretical interpretation of the test in ordinary soils and rocks is presently well developed. In frozen soils, the method has been used for creep properties determination since 1973 (see Ladanyi, B. and Johnston, G. M., "Evaluation of In-Situ Creep Properties of Frozen Soils with the Pressuremeter", Proc. 2nd Int. Permafrost Conf., Yakutsk, USSR, North Amer. Contribution, NAS, Washington, D.C., (1973), pages 310–318). Being based on a discontinuous penetration mode, the PMT method gives information limited only to certain previously selected levels and thus does not provide a continuous soil profile. In addition, the method requires a rather sophisticated apparatus and a skilled personnel.

In the DMT method, introduced by Marchetti in 1980 (see Marchetti, S., "In-Situ Tests by Flat D-Y61 ilatometer", J. of Geotech. Engrg. Div., ASCE, Vol. 106, No. GT3, (1980), pages 299–321), use is made of a soil testing tool ressembling a thick spade, which is pushed into the soil at the end of a drill rod. The measurement is made by slightly inflating a metallic diaphragm located at one side of the spade. The test interpretation is based exclusively on statistical correlations with soil properties deduced from other, more advanced, types of tests, and thus the information furnished is not clear and lacks theoretical background.

SUMMARY OF THE INVENTION

It is therefore an object of the present invention to overcome the above drawbacks and to provide a method and device for in-situ determination of rheological properties of earth materials, which do not require a skilled personnel and which are capable of furnishing a continuous soil profile and a more complete rheological information.

According to one aspect of the invention, there is provided a method for determining in-situ creep properties of earth materials, which comprises the steps of:

a) providing a cone penetrometer having a conical end portion with a central longitudinal axis and a taper angle ranging between about 1° and about 10° relative to the central longitudinal axis;

b) drilling into an earth material borehole having a conical wall portion merging with a concentric cylindrical wall portion of smaller diameter at the bottom of the borehole, the conical wall portion of the borehole corresponding in size and shape to the conical portion of the penetrometer;

c) inserting the penetrometer into the borehole such that the conical portion of the penetrometer abuts the conical wall portion of the borehole;

d) applying a constant load to the penetrometer to cause axial displacement of the conical portion thereof into the borehole and widening of the conical and cylindrical wall portions;

e) continuously monitoring penetration of the conical portion of the penetrometer into the borehole and recording the amount of axial displacement of the conical portion as a function of time, to provide recorded data representative of creep properties of the earth material; and f) determining from the recorded data at least one creep parameter of the earth material.

Applicant has found quite unexpectedly that the creep properties of earth materials can be determined by pushing a low-angle cone penetrometer under a constant axial load into a pre-drilled conical hole of the same shape at the bottom of a borehole in the material, which ends with a pre-drilled drilled cylindrical pilot hole of smaller diameter, and by observing the time-dependent axial displacement of the cone, tending to enlarge both the conical and pilot holes. The major part of deformation is thus radial and occurs under plane strain condition. By the expression "low-angle cone penetrometer" as used herein is meant a penetrometer having a conical portion with a taper angle ranging between about 1° and about 10°.

The taper angle of the conical portion of the penetrometer is selected as a function of the type of material tested and preferably ranges from about 1° to about 5°. For example, a taper angle of about 5° has been found suitable for testing ice and frozen soil, while a taper angle of about 2° is preferable for testing a much stronger rocksalt.

Generally, an axial load of up to about 20 MPa can be applied to the upper end of the penetrometer, when testing ice and frozen soil, but much higher loads of up to 100 MPa are needed for testing rocksalt. A load ranging between about 0.5 and about 3.0 MPa has been found adequate for testing ice. In the case of frozen soil, however, a load ranging between about 3.0 and about 15.0 MPa is preferable.

In a preferred embodiment, steps (d), (e) and (f) of the method according to the invention are repeated a predetermined number of times with the penetrometer remaining in the borehole to provide a multi-stage testing of the earth material, and the load applied to the penetrometer is increased at each stage. The duration of each stage at constant load is usually between 1 and 10 hours, but the longer the better, the only limitation being the depth of the pilot hole. If the load is kept constant, a steady-state penetration velocity is attained only at relatively high loads. Otherwise, the velocity keeps decreasing with time. For example, in tests carried out in ice, for a range of applied loads between 0.5 and 2.6 MPa, the recorded steady-state penetration rates varied from $1.7\times10^{-6}$ to $33.3\times10^{-6}$ cm/sec.

The above method makes it possible to perform hole expansion tests at high pressures, without requiring sophisticated and expensive equipment, while furnishing creep properties of materials such as ice, frozen soils and other strong creeping materials, such as rocksalt.

Applicant has also found that the time or rate-dependent deformation and strength properties of earth materials can be determined by holding constant either the load on the cone or the rate of penetration into the pilot hole, and by recording the relationship between the penetration or the penetration rate and the total lateral pressure exerted by the earth material on the lateral surface of the cone, which is related to the resistance of the material against the enlargement of the pilot hole.

Accordingly, the present invention provides, in another aspect thereof, a method for determining in-situ time or rate-dependent deformation and strength properties of earth materials, which comprises the steps of:

a) providing a cone penetrometer having a conical end portion with a central longitudinal axis and a taper angle ranging between about 1° and about 10° relative to the central longitudinal axis, the conical portion having small and large diameter ends and a lateral surface defined therebetween, and comprising pressure sensing means including at least three longitudinally spaced sensor elements flush mounted on the lateral surface;

b) drilling into an earth material a pilot hole having a diameter corresponding to the small diameter end of the conical portion of the penetrometer;

c) inserting the penetrometer into the pilot hole;

d) applying a load to the penetrometer to cause axial displacement of the conical portion thereof into the pilot hole and enlargement of same;

e) continuously monitoring penetration of the conical portion of the penetrometer into the pilot hole while simultaneously monitoring total lateral pressure exerted by the earth material on the lateral surface of the conical portion and sensed by the sensor elements, and recording the sensed lateral pressures as a function of axial displacement of the conical portion, to provide recorded data representative of time or rate-dependent deformation and strength properties of the earth material; and f) determining from the recorded data the time or rate-dependent deformation or strength property of the earth material.

According to a further aspect of the invention, there is also provided a device for carrying out the above method, which comprises a main elongated body having a conical end portion with a central longitudinal axis and a taper angle ranging between about 1° and about 10° relative to the central longitudinal axis, the conical portion having small and large diameter ends and a lateral surface defined therebetween, and pressure sensing means including at least three longitudinally spaced sensor elements flush mounted on the lateral surface. The device of the invention is insertable into a pilot hole formed in an earth material and having a diameter corresponding to the small diameter end of the conical portion such that upon application of a load to the device, the conical portion is axially displaced into the pilot hole thereby causing enlargement of same, the sensor elements being operative to sense total lateral pressure exerted by the earth material on the lateral surface of the conical portion, the sensed lateral pressures correlated to the axial displacement of the conical portion being representative of time or rate-dependent deformation and strength properties of the earth material.

Preferably, the pressure sensing means comprise three flush diaphragm-type pressure transducers arranged at different levels in the conical portion of the penetrometer, each pressure transducer being operative to sense, at a given level of the earth material, a different value of the total lateral pressure exerted by the material, since at each given level, the total amount of hole enlargement is different as each successive transducer passes through that level. In other words, for each selected level, the method of the invention enables one to determine several points of a "pressuremeter curve", that is, the relationship between lateral pressures and radial displacements, the interpretation of which in terms of rheological properties is well known for different types of earth materials. In this regard, reference can be made to the aforementioned Ladanyi and Johnston publication as well as to the testbook entitled "The Pressuremeter and Foundation Engineering", by Baguelin, F., Jezequel, J. F., and Shields, D. H., First Edition, 1978, Trans Tech Publications.

For testing saturated clays, it is preferable to use a penetrometer of the above type having a conical portion with a taper angle of about 1° to 2°. On the other hand, larger angles of up to and above 5° may be found more appropriate when testing very compressible materials, such as loose sands and peat. In the case of loose sand, taper angles of about 5° to 8° are preferred, whereas in the case of peat, angles of about 8° to 10° are usually more adequate.

Generally, a rapid rate of penetration of, for example, 2 to 20 mm/sec. is recommended for obtaining an undrained response of a saturated clay. A much slower rate of penetration of, for example, 1 to 10 cm/hour is recommended for testing for instance the effects of pore pressure dissipation on the soil behavior. The easiest way to achieve such very slow rates of penetration is to keep constant the axial load applied to the cône, since at small applied loads, the rate will be as slow as desired.

The method and device of the invention not only furnish a continuous soil profile, but also a substantially complete rheological information, without requiring a skilled personnel.

BRIEF DESCRIPTION OF THE DRAWINGS

Further features and advantages of the invention will become more readily apparent from the following description of preferred embodiments as illustrated by way of examples in the accompanying drawings, in which:

FIG. 5 is a log-log plot of the relationship between the relative cone penetration and time, for the determination of creep parameter by;

DESCRIPTION OF PREFERRED EMBODIMENTS

Figure 1:
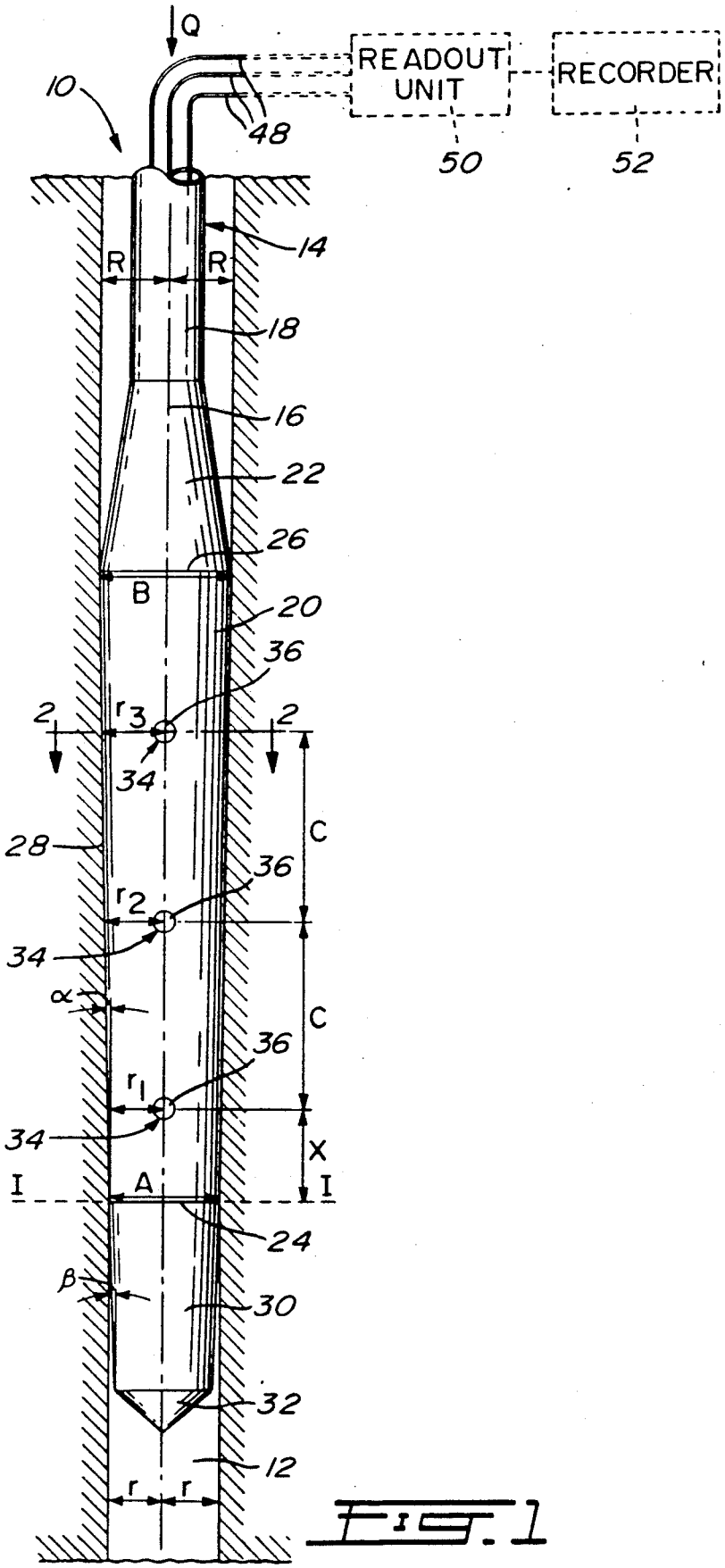
FIG. 1 is a side view of a low-angle cone penetrometer according to a preferred embodiment of the invention, seen inserted into a pilot hole.

Referring first to FIG. 1, there is illustrated a low-angle cone penetrometer generally designated by reference numeral 10 and seen inserted into a pilot hole 12. The cone penetrometer 10 has an elongated body 14 with a central longitudinal axis 16 and comprises a cylindrical member 18 and a hollow, truncated conical head 20 which is connected to the member 18 by means of a connector member 22. The conical head 20 has small and large diameter ends 24 and 26 with respective diameters A and B, and a lateral surface 28 defined therebetween, the head having a taper angle $\alpha$ relative to the central longitudinal axis 16. A concentric, truncated conical guide nose 30 terminating in a short pointed tip 32 is connected to the small diameter end 24 of the head 20; the guide nose 30 has a taper angle $\beta$ which is slightly greater than the taper angle $\alpha$ of the head 20. In the embodiment illustrated, the angle $\alpha$ is about 1° whereas the angle $\beta$ is about 2°.

Figure 2:
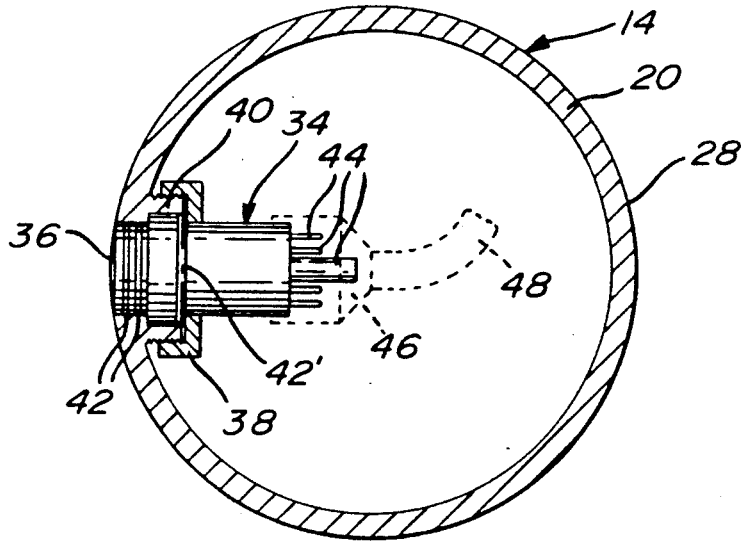
FIG. 2 is a sectional view taken along line 2—2 of FIG. 1.

Three equidistantly spaced-apart flush diaphragm-type pressure transducers 34 are arranged in the head 20, each transducer having a pressure diaphragm 36 flush mounted on the lateral surface 28 of the head. The pressure diaphragms 36 define sensor elements operative to sense total lateral pressure exerted by the surrounding earth material on the lateral surface 28. As shown in FIG. 2, each transducer 34 is mounted by means of a threaded collar 38 engaging a threaded flange 40 inside the head 20. Three o-rings 42, 42' are arranged to ensure adequate sealing. The transducer pins 44 are received into an electrical socket 46 and are electrically connected by a wire 48 to a readout unit 50 which itself is connected to a recorder 52. The first or lowermost transducer is disposed at a distance X from the small diameter and 24 of the head, whereas the second transducer is disposed at a distance C from the first and the third or uppermost transducer is disposed at a same distance C from the second.

In operation, the cone penetrometer 10 is inserted into a pre-drilled pilot hole 12 having a diameter 2r corresponding to the diameter A of the small diameter end 24 of the conical head 20. If desired, for the start of the test, the upper portion of the pilot hole can be enlarged to have a conical configuration corresponding in size and shape to the conical head 20. The pilot hole can be made either before the test by pre-drilling, or simultaneously with the cone penetration by means of a self-boring device which is readily commercially available. An axial load Q is then applied to the upper end of the penetrometer 10 to cause axial displacement of the conical head 20 into the pilot hole 12 and enlargement of same. The total lateral pressure exerted by the earth material on the lateral surface 28 of the head 20 and sensed by the sensor elements 36 is continuously monitored and recorded by the recorder 52. Penetration of the head 20 into the pilot hole 12 is also continuously monitored at the same time by suitable means (not shown) and recorded by recorder 52. The sensed lateral pressures are recorded as a function of axial displacement of the head 20, thereby providing recorded data representative of time or rate-dependent deformation and strength properties of the earth material. The time or rate-dependent deformation or strength property of the material is then deduced from the recorded data.

As the conical head 20 is axially displaced into the pilot hole 12, the pilot hole of diameter 2r is gradually enlarged to the diameter 2R corresponding to the diameter B of the large diameter end 26 of the head. The three pressure transducer 34 also traverse successively the distances x, (x−c) and (x+2C), so that total radial strains (equal to shear strains) at a fixed level I—I are equal to:

| Penetration | Radial Displacement | Radial Strain |
|---|---|---|
| X | $r_1 - r$ | $\ln(r_1/r)$ |
| X + C | $r_2 - r$ | $\ln(r_2/r)$ |
| X + 2C | $r_3 - r$ | $\ln(r_3/r)$ |

where $$r_1 = r + X\tan\alpha$$

$$r_2 = r + (X + C)\tan\alpha$$

$r_3 = r + (X + 2C)\tan\alpha$

Taking, for example, a cone penetrometer 10 having a conical head 20 with $\alpha = 1°$, intended to enlarge a pilot hole from r=3.0 cm to R=3.5 cm, and pressure transducers 34 positioned at distances of 5 cm, 15 cm and 25 cm, respectively, from the small diameter end 24 of the head, for a penetration of X=5 cm, one would get at the level I—I in FIG. 1 a shear strain equal to ln $(1+5\times0.01746/3)=0.0287$, and the corresponding pressure sensed by the first or lowermost pressure transducer will be $p_1$. A penetration of 15 cm gives the strain ln $(1+15\times0.01746/3)=0.0837$, and the corresponding pressure sensed by the second pressure transducer will be $p_2$. Finally, a penetration of 25 cm leads to a strain of ln $(1+25\times0.01746/3)=0.1358$, and the corresponding pressure sensed by the third or uppermost pressure transducer will be $p_3$. Had, for example, an angle $\alpha=2°$ been selected for the conical head 20 instead of 1°, the corresponding shear strains would have been 0.057, 0.161 and 0.225, respectively.

The strains will remain the same as long as the pilot hole 12 precedes the conical head 20, but the recorded pressures will vary according to the soil properties.

Figure 3:
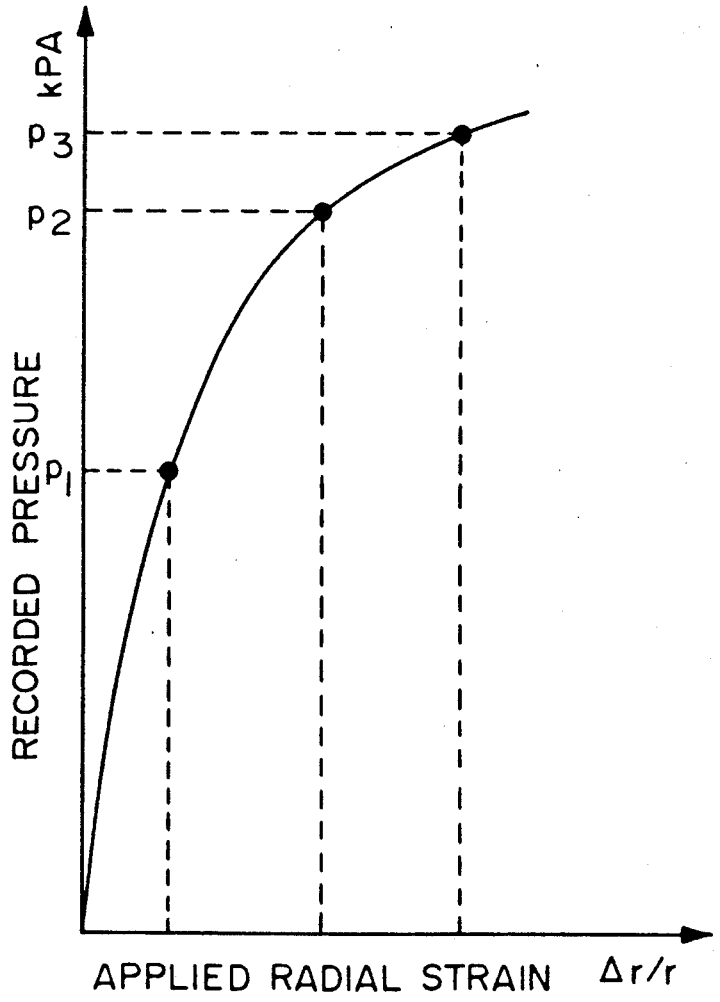
FIG. 3 is a plot of recorded lateral pressure against the relative enlargement of the pilot hole resulting from cone penetration.

By relating the radial (or shear) strains with the corresponding pressures sensed by the pressure transducers at different levels of the pilot hole, one thus obtains a number of "pressuremeter curves", such as shown schematically in FIG. 3. These curves can then be treated in a conventional manner, described for instance in the aforementioned Ladanyi and Jonston publication, to determine the time or rate-dependent deformation and strength properties of the material tested, such as the time or rate-dependent stress-strain curve.

In addition to the pressure transducer 34 for sensing the total lateral pressure, some piezometric transducers (not shown) can also be installed on the conical head 20 for measuring generation and dissipation of pore pressure around the head 20.

Figure 4:
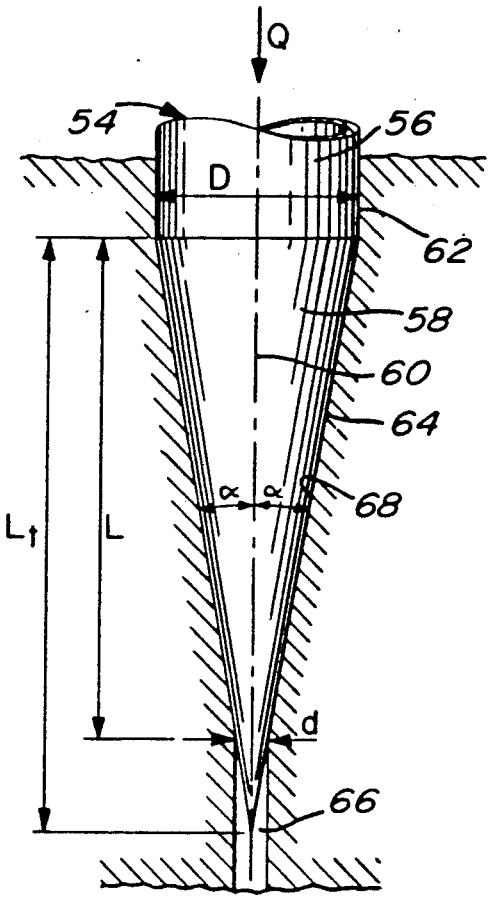
FIG. 4 is a view similar to FIG. 1, showing a low-angle cone penetrometer according to another preferred embodiment of the invention.

Turning to FIG. 4, there is illustrated another type of low-angle cone penetrometer 54 comprising a cylindrical member 56 to which is connected a conical head 58 having a taper angle $\alpha$ of about 10° relative to the central longitudinal axis 60. As shown, the penetrometer 54 is seen inserted into a borehole 62 having a conical portion 64 merging with a concentric cylindrical portion 66 of smaller diameter, the cylindrical hole portion 66 defining a pilot hole. As opposed to the embodiment illustrated in FIG. 1, testing with the penetrometer 54 requires starting from a pre-drilled conical hole portion 64 corresponding in size and shape to the conical head 58.

Generally, the pilot hole 66 is drilled first and then, using a sharp conical tool having the same taper angle $\alpha$ as the conical head 58, the upper portion of the pilot hole is enlarged to the size and shape of the head 58. The penetrometer 54 is thereafter inserted into the borehole such that the conical head 58 abuts the conical wall portion 68 defined by the conical hole portion 64. A constant load Q is applied to the upper end of the penetrometer 54 to cause axial displacement of the head 58 into the borehole 62 and enlargement of the conical and cylindrical hole portion 64 and 66. Penetration of the head 58 into the cylindrical hole portion or pilot hole 66 is continuously monitored by suitable means (not shown) and the amount of axial displacement of the head 58 is recorded as a function of time, thereby providing recorded data representative of creep properties of the earth material tested. At least one creep parameter (i.e. creep parameters b, n and/or $\sigma_{c\theta}$) of the material is then deduced from the recorded data.

The size and shape of the conical head 58 depend on the selection of the taper angle $\alpha$ and the diameters D and d of the main and pilot holes 62 and 66, respectively. For selected values of $\alpha$, D and d, the total length $L_t$ of the head 58 is given by:

$$L_t = (D/2)\cot\alpha \quad (1)$$

and the length L of the head 58 in contact with the earth material is given by:

$$L = [(D-d)/2]\cot\alpha \quad (2)$$

For example, if $\alpha=5°$, D=3.556 cm and d=0.635 cm, one gets: $L_t$=5.715 D=20.32 cm−16.70 cm=3.62 cm will always remain in the pilot hole 66 without contact with the wall, and will serve only a guide during penetration.

However, if the angle $\alpha$ is very small and the two diameters D and d are large, such as $\alpha=1°$, D=7.0 cm and d=6.0 cm, one gets from the above equations (1) and (2):

$$L_t = 28.6D = 200.2 \text{ cm, and}$$

$$L = 28.6(D-d) = 28.6 \text{ cm.}$$

Clearly, in that case, the total length of the conical head 58 is too large and it is preferable to cut the tip of the cone, so that only a reasonable length of the cone is retained as a guiding portion within the pilot hole 66.

Figure 5:
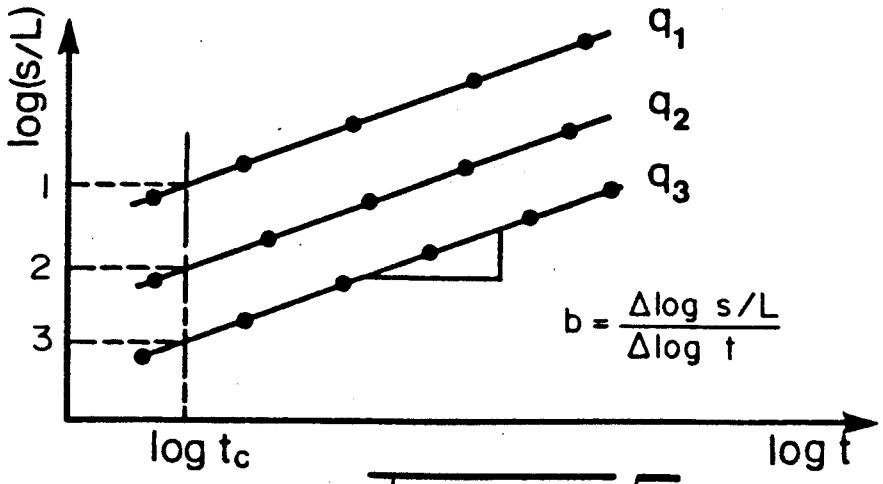
Figure 6:
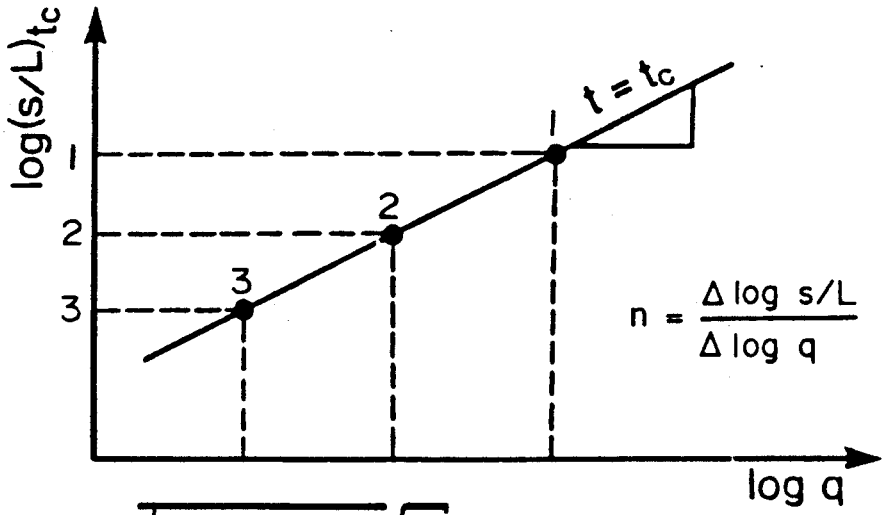
FIG. 6 is a log-log plot of the relationship between the load applied and the relative cone penetration, for the determination of creep parameters n and $\sigma_{c\theta}$.

The creep properties of the earth material tested with the penetrometer 54, can be determined by finding the values of creep parameters in the creep equation of the tested material. For example, for ice, frozen soils and rocksalt, the creep equation has usually the form:

$$\epsilon_c = (\sigma_e/\sigma_{c\theta})^a(\dot{\epsilon}_c t/b)^b \quad (3)$$

where $\sigma_c$ and $\dot{\epsilon}_c$ are von Mises equivalent stress and strain, respectively, n and b are creep exponents, t is the time, and $\sigma_{c\theta}$ is the reference stress at a temperature $\theta$ and at a reference strain rate $\dot{\epsilon}_c$. The parameters to be determined by the test are n, b and $\sigma_{c\theta}$. This can be done by performing, in a single borehole, or in different parallel boreholes, a series of test at different axial loads. FIGS. 5 and 6 show the principle of determination of these parameters in Eq. (3).

The value of b can be found from a single test by plotting the measured values of the ratio s/L against the time, t, in a log-log plot, where for this type of behavior a creep curve linearizes. Here, s denotes the axial displacement of the conical head 58 and L its length in contact with the borehole wall 68, as shown in FIG. 4. The value of b is the slope of the line representing the experimental creep curve as shown in FIG. 5.

The value of n can be found if either a stage-loaded test is performed in the hole, or if several step-loaded tests at different loads are performed in separate holes under nearly identical conditions. If Eq. (3) represents correctly the tested material behavior, then these tests will give a set of nearly parallel straight lines, each of them valid for a different net pressure q, as in FIG. 5. The value of n can be found by plotting in a log-log plot the values of s/L, read at an arbitrary time $t=t_c$. This will result in a straight line, such as in FIG. 6. The value of n is the slop of this line.

Finally, the value of $\sigma_{c\theta}$ can be found by taking the coordinates of any point on the straight line in FIG. 6 (which is valid for $t=t_c$), say, $q_1$ and $(s/L)_1$, from which it is found that:

$$\sigma_{c\theta}=q_1(\sqrt{3}/N)[A(\dot{\epsilon}_c t_c/b)^b(\sqrt{3}/2)/(s/L)_1]^{1/n} \quad (4)$$

where $$A=\left\{\frac{(2-1/n)}{2(1+\tan\delta/\tan\alpha)[1-(d/D)^{2-1/n}]}\right\}^n(1-d/D)^{-1}$$

with δ being the angle of friction between the cone and the earth material.

It is found sometimes that a minimum creep rate formulation describes better the material behavior than the primary rate formulation described above. For processing the test results in such a case, it is sufficient to put b=1 in Eq. (3) and to differentiate it with respect to time. This yields the basic creep rate equation:

$$\dot{\epsilon}_c=\dot{\epsilon}_c(\sigma_c/\sigma_{c\theta})^n \quad (5)$$

Figure 7:
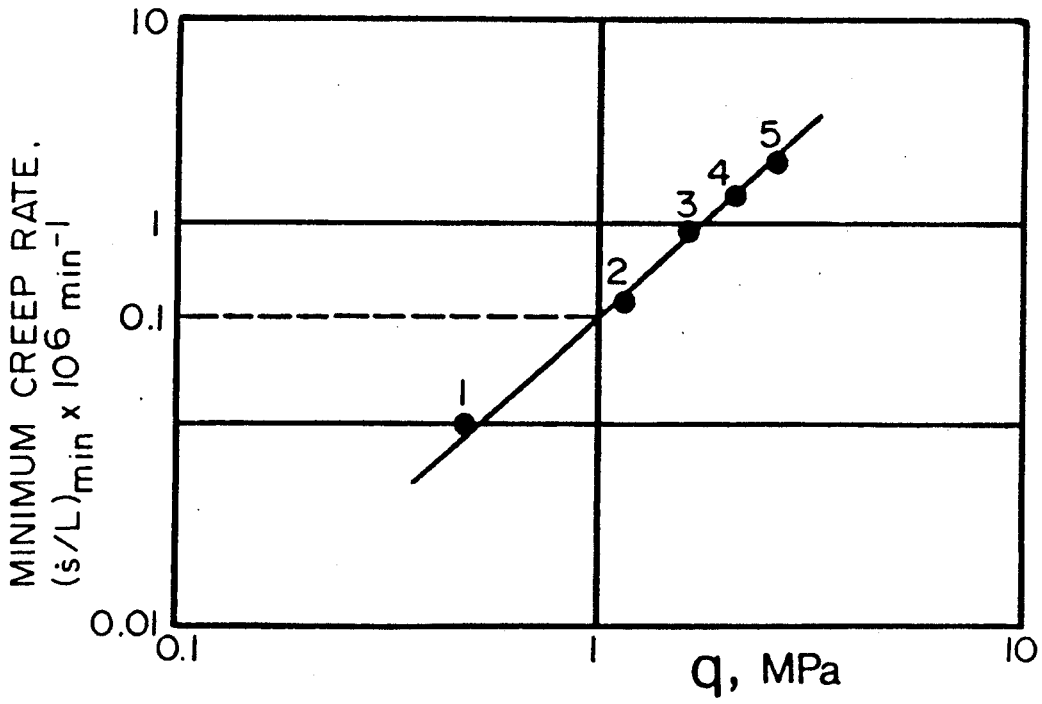
FIG. 7 is a log-log plot of the minimum relative penetration rate and the applied load, for the determination of creep parameters n and $\sigma_{c\theta}$ in the case of minimum creep rate formulation.

As shown in FIG. 7, in order to find n in Eq. (5), it is necessary to plot $(s/L)_{min}$ against q in a log-log plot, giving a straight line with the slop $n=\log(s/L)_{min}/\log q$. In order to find the value of $\sigma_{c\theta}$, it is only necessary to read from that line the coordinates of an arbitrary point, say, $(s/L)_{min,1}$ at $q=q_1$, from which:

$$\sigma_{c\theta}=q_1(\sqrt{3}/N)[A\dot{\epsilon}_c(\sqrt{3}/2)/(s/L)_{min,1}]^{1/n} \quad (6)$$

A series of tests performed in polycrystalline ice at a temperature of −5° C., using a low-angle cone penetrometer 54 having a conical head 58 with a taper angle of 5°, in which the head was made to penetrate in a pilot hole with a diameter of d=0.635 cm, gave the following results when interpreted according to the above minimum creep rate formulation:

TABLE 1

| Test No. | Minimum Creep Rates q (MPa) | $(s/L)_{min}$ (in $10^{-7}$ $min^{-1}$) |
|---|---|---|
| 1 | 0.48 | 1.00 |
| 2 | 1.13 | 3.83 |
| 3 | 1.61 | 9.50 |
| 4 | 2.10 | 13.70 |
| 5 | 2.58 | 20.00 |

These values plotted in FIG. 7, are seen to fall quite well on a straight line, the slope of which gives n=1.90, which is within the range of n values usually found for such ice (1.75 to 2.40). The value of $\sigma_{c\theta}$ can be found from any point on that line, say $(s/L)_{min}=3.46\times10^{-7}$ $min^{31\ 1}$ at q=1 MPa. Taking into account the measured friction on the conical head 58, one finds from Eq. (6) the value: $\sigma_{c\theta}=4.76$ MPa, for a reference creep rate of $10^{-5}$ $min^{-1}$. The minimum creep rate equation found from the tests is then:

$$\dot{\epsilon}_c=10^{-5}(\sigma_c/4.76)^{1.9\ tm} \quad (7)$$

It is clear that the value of $\sigma_\theta$ found in the tests at a temperature of −5° C. should be modified for other temperatures using empirical relationships known in the literature.

Other similar tests made in frozen sand have also given reasonable values of creep parameters comparable to those determined by laboratory creep tests.

I claim:

1. A method for determining in-situ creep properties of earth materials, which comprises the steps of:

a) providing a cone penetrometer having a conical end portion with a central longitudinal axis and a taper angle ranging between about 1° and about 10° relative to said central longitudinal axis;

b) drilling into an earth material a borehole having a conical wall portion merging with a concentric cylindrical wall portion of smaller diameter at the bottom of said borehole, the conical wall portion of said borehole corresponding in size and shape to the conical portion of said penetrometer;

c) inserting said penetrometer into said borehole such that the conical portion of said penetrometer abuts the conical wall portion of said borehole;

d) applying a constant load to said penetrometer to cause axial displacement of the conical portion thereof into said borehole and widening of the conical and cylindrical wall portions;

e) continuously monitoring penetration of the conical portion of said penetrometer into said borehole and recording the amount of axial displacement of said conical portion as a function of time, to provide recorded data representative of creep properties of said earth material; and f) determining from said recorded data at least one creep parameter of said earth material.

2. A method as claimed in claim 1, wherein said earth material is ice and wherein the penetrometer used has a conical portion with a taper angle of about 5°.

3. A method as claimed in claim 1, wherein said earth material is frozen soil and wherein the penetrometer used has a conical portion with a taper angle of about 5°.

4. A method as claimed in claim 1, wherein said earth material is rocksalt and wherein the penetrometer used has a conical portion with a taper angle of about 2°.

5. A method as claimed in claim 1, wherein a load of up to about 100 MPa is applied to said penetrometer in step (d).

6. A method as claimed in claim 2, wherein a load ranging between about 0.5 and about 3.0 MPa is applied to said penetrometer in step (d).

7. A method as claimed in claim 3, wherein a load ranging between about 3.0 and about 15.0 MPa is applied to said penetrometer in step (d).

8. A method as claimed in claim 1, wherein steps (d), (e) and (f) are repeated a predetermined number of times with said penetrometer remaining in said borehole to provide a multi-stage testing of said earth material, and wherein the load applied to said penetrometer is increased at each stage.

9. A method as claimed in claim 8, wherein the creep parameters determined are creep exponents n and b and reference stress $\sigma_{c\theta}$ of said earth material.

10. A method for determining in-situ time or rate-dependent deformation and strength properties of earth materials, which comprises the steps of:

a) providing a cone penetrometer having a conical end portion with a central longitudinal axis and a taper angle ranging between about 1° and about 10° relative to said central longitudinal axis, said conical portion having small and large diameter ends and a lateral surface defined therebetween, and comprising pressure sensing means including at least three longitudinally spaced sensor elements flush mounted on said lateral surface;

b) drilling into an earth material a pilot hole having a diameter corresponding to the small diameter end of the conical portion of said penetrometer;

c) inserting said penetrometer into said pilot hole;

d) applying a load to said penetrometer to cause axial displacement of the conical portion thereof into said pilot hole and enlargement of same;

e) continuously monitoring penetration of the conical portion of said penetrometer into said pilot hole while simultaneously monitoring total lateral pressure exerted by the earth material on the lateral surface of said conical portion and sensed by said sensor elements, and recording the sensed lateral pressures as a function of axial displacement of said conical portion, to provide recorded data representative of time or rate dependent deformation and strength properties of said earth material; and f) determining from said recorded data the time or rate-dependent deformation or strength property of said earth material.

11. A method as claimed in claim 10, wherein said earth material is a saturated clay and the penetrometer used has a conical portion with a taper angle of about 1° to 2°.

12. A method as claimed in claim 10, wherein said earth material is loose sand and the penetrometer used has a conical portion with a taper angle of about 5° to 8°.

13. A method as claimed in claim 10, wherein said earth material is peat and the penetrometer used has a conical portion with a taper angle of about 8° to 10°.

14. A method as claimed in claim 10, wherein a constant load is applied to said penetrometer in step (d).

15. A method as claimed in claim 10, wherein a variable load is applied to said penetrometer in step (d), whereby to cause said conical portion to penetrate said pilot hole at a substantially constant rate.

16. A method as claimed in claim 15, wherein the rate of penetration of said conical portion ranges from about 2 to about 20 mm/sec.

17. A method as claimed in claim 15, wherein the rate of penetration of said conical portion ranges from about 1 to about 10 cm/hour.

18. A method as claimed in claim 10, wherein steps (b) and (d) are performed simultaneously.

19. A method as claimed in claim 10, wherein the properties determined in step (f) include a time or rate-dependent stress-strain curve of said earth material.

20. A device for determining in-situ time or rate-dependent deformation and strength properties of earth materials, which comprises:

a main elongated body having a conical end portion with a central longitudinal axis and a taper angle ranging between about 1° and about 10° relative to said central longitudinal axis, said conical portion having small and large diameter ends and a lateral surface defined therebetween; and pressure sensing means including at least three longitudinally spaced sensor elements flush mounted on said lateral surface; said device being insertable into a pilot hole formed in an earth material and having a diameter corresponding to the small diameter end of said conical portion such that upon application of a load to said device, said conical portion is axially displaced into said pilot hole thereby causing enlargement of same, said sensor elements being operative to sense total lateral pressure exerted by the earth material on the lateral surface of said conical portion, the sensed lateral pressures correlated to the axial displacement of said conical portion being representative of time or rate-dependent deformation and strength properties of said earth material.

21. A device as claimed in claim 20, wherein said taper angle ranges between about 1° and about 5°.

22. A device as claimed in claim 21, wherein said taper angle is about 1°.

23. A device as claimed in claim 20, wherein said pressure sensing means comprise flush diaphragm-type pressure transducers.

24. A device as claimed in claim 20, wherein said sensor elements are longitudinally aligned with one another.

25. A device as claimed in claim 24, wherein said sensor elements are equidistantly spaced from one another.

26. A device as claimed in claim 21, wherein said conical portion is truncated at said small diameter end and a concentric conical guide nose is connected to said small diameter end, said conical guide nose having a taper angle greater than the taper angle of said conical portion.

27. A device as claimed in claim 26, wherein the taper angle of said conical guide nose is about 1° greater than the taper angle of said conical portion.

28. A device as claimed in claim 26, wherein said conical guide nose is truncated at a free end thereof and terminates in a short pointed tip.

* * * * *